US006450178B1

(12) United States Patent
Clay

(10) Patent No.: US 6,450,178 B1
(45) Date of Patent: Sep. 17, 2002

(54) INTERACTIVE MASCARA BRUSH[2]

(76) Inventor: Mary A. Clay, 2770 E. Uintah #305, Colorado Springs, CO (US) 80909

( * ) Notice: Subject to any disclaimer, the term of this patent is extended or adjusted under 35 U.S.C. 154(b) by 0 days.

(21) Appl. No.: 09/648,051

(22) Filed: Aug. 25, 2000

Related U.S. Application Data

(63) Continuation-in-part of application No. 09/387,547, filed on Aug. 31, 1999, now Pat. No. 6,145,514.

(51) Int. Cl.[7] ..... A45D 40/26; A45D 40/24
(52) U.S. Cl. ..... 132/218; 132/317; 132/320
(58) Field of Search ..... 132/218, 317, 132/320, 216; 15/164, 172; 401/122, 126, 129

(56) References Cited

U.S. PATENT DOCUMENTS 3,739,416 A * 6/1973 Kurachi ..... 15/164
4,084,282 A * 4/1978 Calvert ..... 15/38
4,632,136 A 12/1986 Kingsford ..... 132/88.77
5,086,793 A * 2/1992 Kingsford ..... 132/218
5,937,871 A * 8/1999 Clay ..... 132/218

* cited by examiner

*Primary Examiner*—John J. Wilson
*Assistant Examiner*—Robyn Kieu Doan
(74) *Attorney, Agent, or Firm*—Mark G. Pannell; Hanes & Schutz, P.C.

(57) ABSTRACT

An interactive mascara applicator (10) comprising: a handle end portion (40); an opposite bristle/brush end portion (80); and a rotating disc (50) positioned about the handle end portion (40) which when moved causes the bristles to change positions with respect to the applicator (10), so that one may hold the handle end portion (40) and move the disc (50) with a single hand to apply mascara.

29 Claims, 4 Drawing Sheets

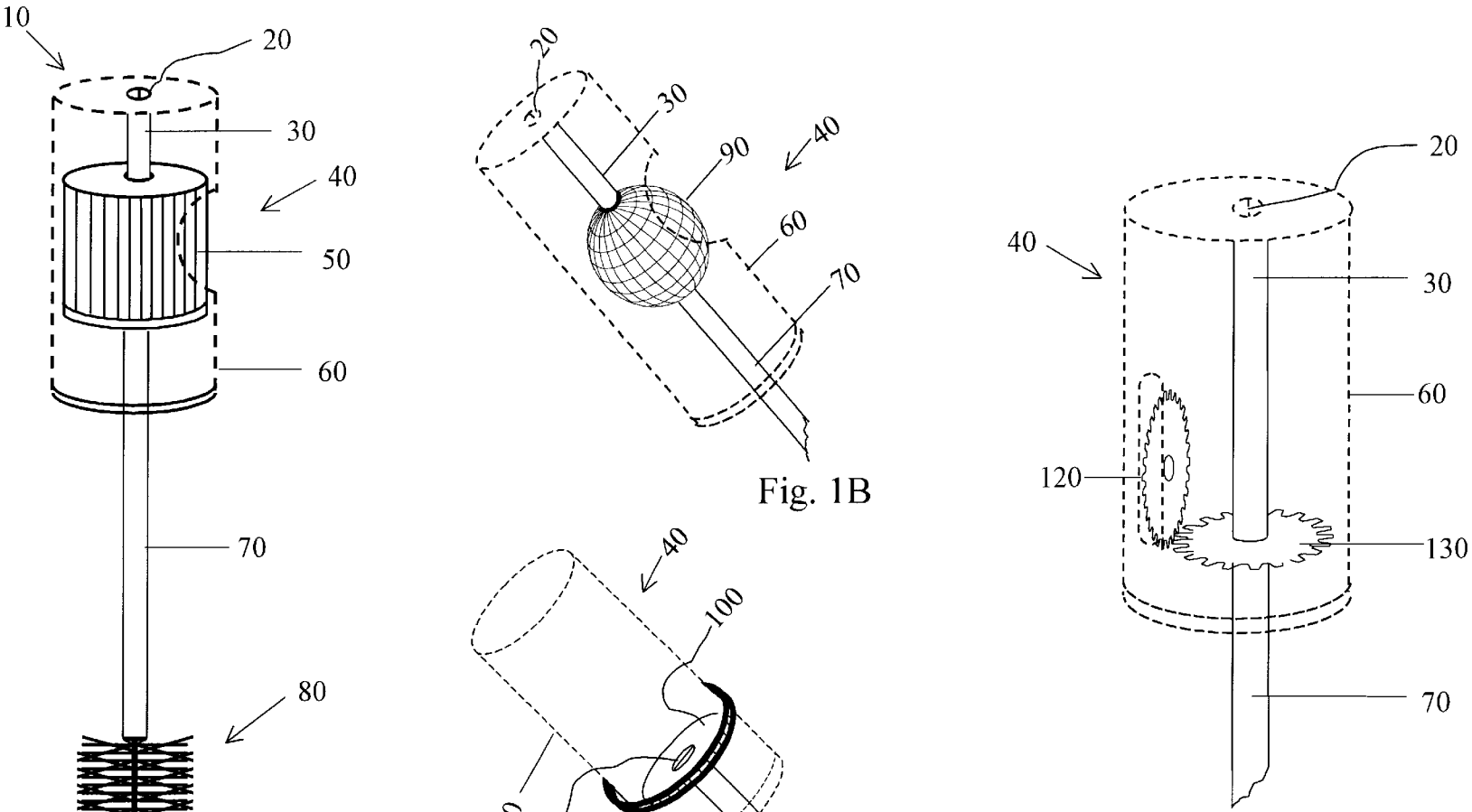
Fig. 1
Fig. 1B
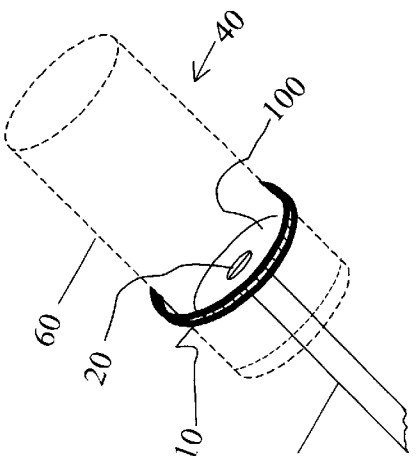
Fig. 1A
Fig. 1C

INTERACTIVE MASCARA BRUSH[2]

CROSS REFERENCE TO RELATED APPLICATION

This application is a continuation-in-part of application Ser. No. 09/387,547, filed Aug. 31, 1999 now U.S. Pat. No. 6,145,514.

BACKGROUND OF THE INVENTION

1. Field of the Invention

This invention relates to an interactive mascara applicator where one aspect comprises; a handle end portion; an opposite brush end portion having bristles; and a rotating sphere or disc positioned about the handle end portion which when moved causes the bristles to change position with respect to the applicator, so that one may hold the handle end portion and move the sphere with a single hand to apply mascara.

2. Description of Related Art

The conventional mascara applicator has a handle located at its top end, a brush located at its bottom end, and a rod located in between the two, connecting the handle with the brush. The handle is used for gripping and maneuvering the entire assembly while the brush is used for stroking and coating the lashes.

The brush section of most commercial mascara applicators are fixed and permanently attached to the rod however, there have been some brush sections shown in the prior art that are adjustable. For example in U.S. Pat. No. 4,446,880 to Gueret & Arraudeau, and U.S. Pat. Nos. 3,998,235 and 5,137,038 to Kingsford, several makeup brushes are described where the bristles within the brush section are adjustable by either changing their immediate spacing, overall diameter, or initial curvature.

In each of the prior art patents disclosed, adjustments to the brush section are shown to occur only prior or subsequent to the actual application. In other words, a user must stop, pre-select the desired adjustment position, and then proceed with using the brush. Further, both hands must be used to make adjustments to the brush.

In my previous U.S. Pat. No. 5,937,871, an interactive mascara brush is disclosed where the bristles within its brush section can be adjusted at any time by using the finger of a single hand. In one embodiment, an applicator is described where its brush section is capable of rotating. However, the number of times that the brush section can rotate, and the degree to which the brush section can achieve a full turn is limited by the inherent restrictions associated with the physical size of the internal parts being used within the assembly.

BRIEF SUMMARY OF THE INVENTION

Accordingly, the advantages of my invention are to disclose an applicator where the brush section can freely rotate. A further advantage is to disclose an applicator where the shape of the brush section and/or the bristle alignment within the brush section can be interactively altered.

These advantages are achieved according to the invention in that the applicator assembly has a rotating sphere or disc located about the assembly's handle end section. When the sphere is moved (turned), the bristles within the brush section react immediately by changing their alignment, shape, or by causing the entire brush section to rotate. In other words, the rotating sphere creates an interactive relationship between a user's operational commands and the derivative positioning of the bristles within its brush section. All adjustments are optional and can be performed at any time by using the finger of a single hand. In addition, the brush section is an expandable sleeve that fits like a glove over the bottom end of the applicator rod and is replaceable.

An interactive approach is defined as a two way mechanical communication system that involves little or no time delay between a mechanical action that gets performed by a user and a reciprocal mechanical reaction that results from the issued operational command. This approach allows a user to engage in and choose from an array of bristle arrangements all without having to stop in the middle of the application process to perform any additional adjustments.

The effect of an "interactive" approach is twofold. First, by giving the bristle 's of the brush the capability to be altered in "real time"—during the actual application of the makeup to the lashes, and by using the finger of a single hand, allows changes in combing or stroking patterns to be immediate and direct resulting in no delays during application. This is especially convenient since most mascara formulas today dry quickly once they get exposed to air. Second, the amount or level of "mechanical adjustment" that occurs among the bristles of the brush, or to the number of times that the brush section rotates is directly controlled by the user.

Further objects and advantages of my invention will become apparent from a consideration of the drawings and ensuing description.

BRIEF DESCRIPTION OF THE DRAWINGS

FIG. 1 shows an internal view of an interactive mascara applicator that enables the brush section to freely rotate. A rotating disc positioned within the handle end section is mainly responsible for accomplishing this task.

FIGS. 1A, 1B, and 1C show internal views of alternate interactive approaches for allowing the brush section to rotate. FIG. 1A uses an external ring, FIG. 1B a rotating sphere, and FIG. 1C uses a set of dials.

DRAWING REFERENCE NUMERALS

Figure 2A:
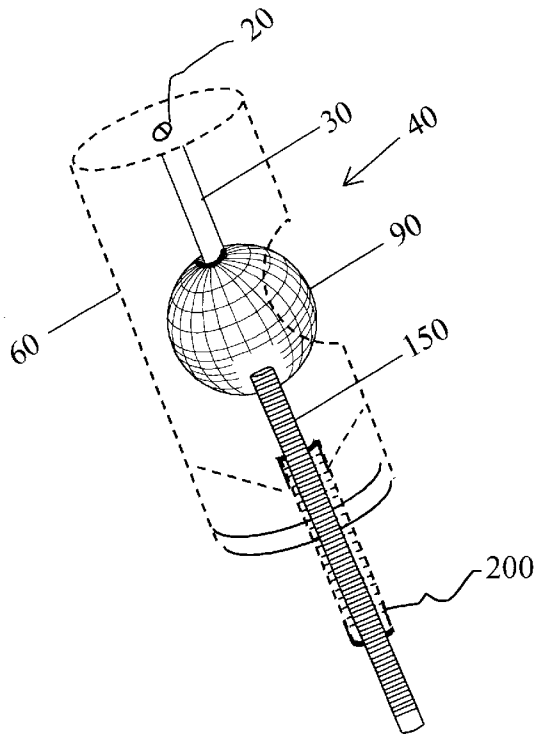
FIG. 2A shows an internal view of an alternate interactive approach that allows changes to the alignment of the bristles within a brush section.

10 Interactive Mascara Brush/Applicator
20 Screw
30 Stationary Bar
40 Handle End Section/Applicator Cap
50 Rotating Disc
60 Applicator Housing/Frame

70 Applicator Rod
80 Brush Section
90 Sphere
100 Internal Ring
110 External Ring
120 External Dial
130 Internal Dial
140 Spring
150 Applicator Rod with Grooves
160 Rotating Bar
170 Rotating Bar Compartment
180 Sleeve Pin
190 Stretchable/Deformable Brush Sleeve
200 Applicator Rod Corridor with Internal Grooves
210 Piston
220 Fill Material
230 Catch and Release Pin
240 Passageway having Bottom End Side Orifice
250 Mascara Applicator
260 Handle
270 Rotational Body
280 Rod
290 Bristles
300 Opening
310 Proximate End
320 Distal End
330 longitudinal Axis

DETAILED DESCRIPTION OF THE INVENTION

FIG. 1 shows an internal view of an interactive mascara applicator 10 with a mechanism that allows rod 70 and brush 80 to freely rotate. Screw 20 attaches the top end of handle 40 to a first end of stationary bar 30. A second end of stationary bar 30 is connected to a first side of disc 50 where disc 50 is rotatably mounted. A second side of disc 50 is fixed to a first end of rod 70. A second end of rod 70 is fixed to a first end of brush 80. The framework outlining handle 40 forms housing 60 and extends to cover a portion of rod 70. Housing 60 also forms a window within handle 40 so that a section of disc 50 is externally exposed.

In an alternative embodiment, bar 30 is rotatably mounted to handle 40 at fastener 20. Disc 50 is fixed to bar 30 and rod 70.

FIG. 1A shows an inside view of handle end 40. Internal ring 100 is attached and rotatably mounted throughout an opening arranged around the internal wall of housing 60. The outer edge of ring 100 is exposed through this opening and is attached to one side of external ring 110 so that movements that occur to ring 110 can be mimicked by ring 100. External ring 110 is attached and rotatably mounted around the outside surface of handle 40. One side of internal ring 100 is fixed to a first end of rod 70 by way of screw 20.

FIG. 1B shows an inside view of handle 40 where sphere 90 is rotatably mounted inside. Screw 20 attaches the top end of handle 40 to a first end of stationary bar 30. A second end of stationary bar 30 is connected to a first opening within sphere 90 where sphere 90 is rotatably mounted. A second opening within sphere 90 is fixed to a first end of rod 70 so that when sphere 90 turns, rod 70 also turns. The framework outlining handle 40 forms housing 60 and extends to cover a portion of rod 70. Housing 60 also forms a window within handle 40 so that a section of sphere 90 is externally exposed.

In an alternate embodiment, bar 30 is rotatably mounted to handle 40 at fastener 20. Sphere 90 is fixed to bar 30 and rod 70.

FIG. 1C shows an internal view of handle 40 where external dial 120 is used to initiate the rotation of rod 70. Screw 20 attaches the top end of handle 40 with a first end of stationary bar 30. A second end of stationary bar 30 is connected to a first side of internal dial 130, where internal dial 130 is rotatably connected. A second side of dial 130 is fixed to a first end of rod 70 so that when dial 130 moves, rod 70 also moves. External dial 120 is positioned perpendicular to internal dial 130 where the teeth located on both dials (120 & 130) communicate with each other. The framework outlining handle 40 forms housing 60 and extends to cover a portion of rod 70. Housing 60 also forms a window within handle 40 so that a portion of the teeth located on dial 120 can be exposed.

In an alternative embodiment, bar 30 is rotatably mounted to handle 40 at fastener 20. Internal dial 130 is fixed to bar 30 and rod 70.

Figure 2:
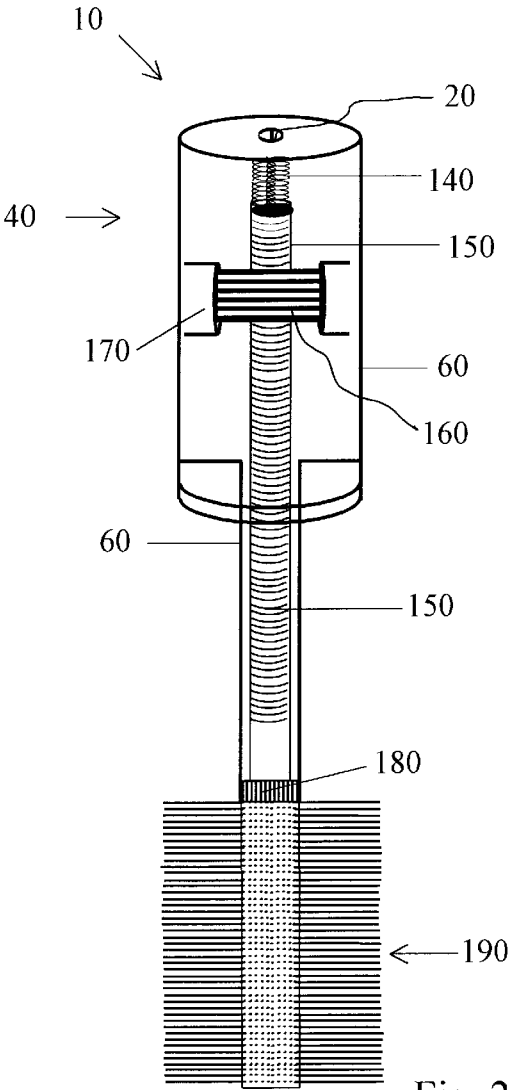
FIG. 2 shows an internal view of a mascara applicator that interactively enables a user to change the alignment of the bristles within its brush section.

FIG. 2 shows an internal view of an interactive mascara applicator 10 that enables a user to change the alignment of the bristles within its brush section. Applicator rod 150 is positioned within handle 40 where its top end is fixed to a first side of spring 140. A second side of spring 140 is connected to a top portion of handle 40 by screw 20. The rest of rod 150 extends through housing 60 where it is slidably positioned. One end of the extended portion of housing 60 is fixed to one side of pin 180. A stretchable/deformable sleeve 190 covers the bottom portion of rod 150 and is releasably attached to a second side of pin 180. The framework outlining handle 40 also forms compartment 170 where bar 160 is located. Rotating bar 160 is positioned relative to rod 150 in a manner that allows the grooves located on both to freely communicate.

FIG. 2A shows an internal view of an alternate interactive approach that varies the length of an applicator's internal rod so that the bristle alignment within its brush section can be modified (bristles are not shown in this figure). Screw 20 attaches the top end of handle 40 with a first end of stationary bar 30. A second end of stationary bar 30 is connected inside a first opening of sphere 90, where sphere 90 is rotatably mounted. A second opening within sphere 90 has grooves located at its entrance. Rod 150 also has grooves located on its surface which permit it to attach itself and move back and forth within sphere 90. Housing 60 extends to form corridor 200 at a lower section of handle 40. Corridor 200 surrounds rod 150 and has grooves located within it that help facilitate and support rod 150's movement in and out of sphere 90.

In an alternative embodiment, bar 30 is rotatably mounted to housing 60 at fastener 20. Sphere 90 is fixed to bar 30.

Figure 3:
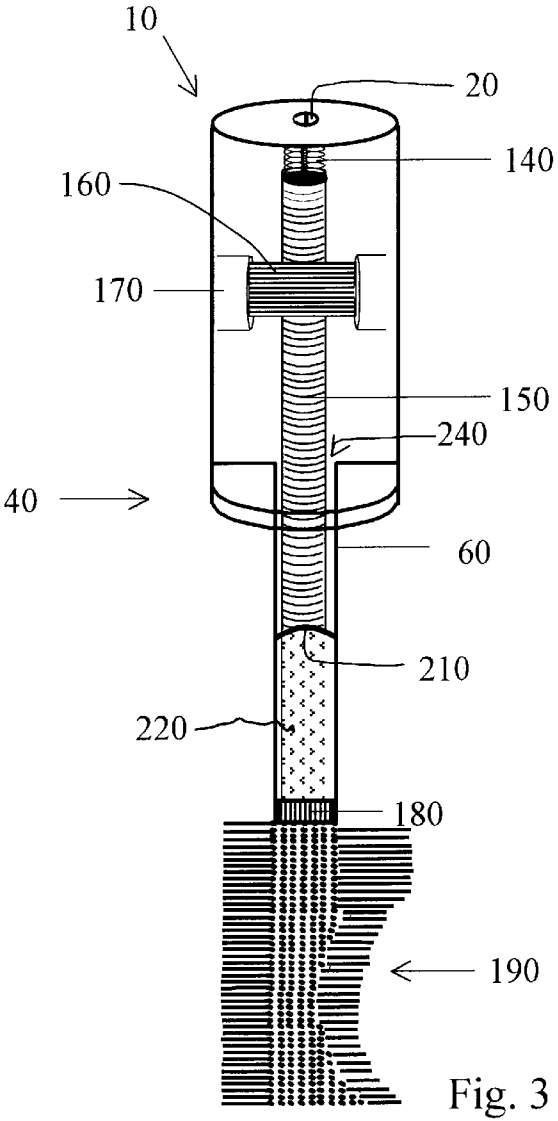
FIG. 3 shows an internal view of an interactive mascara applicator with mechanisms that enable the shape of the brush section to change.

FIG. 3 shows an internal view of an interactive mascara applicator 10 with mechanisms that enable the shape of its brush section 190 to change. Screw 20 attaches the top end of handle 40 to a first end of spring 140. A second end of spring 140 is attached to the top end of rod 150. The bottom end of rod 150 is attached to one side of piston 210. The framework outlining handle 40 forms housing 60 and a passageway 240 for rod 150 and piston 210 to snugly travel through. A bottom area of passageway 240 has an orifice located on its side that forms a curvature. Fill material 220 is located inside passageway 240, below piston 210. Deformable brush sleeve 190 covers passageway 240's side orifice and mimics its curvature shape until it attaches to a first side of pin 180. A second side of pin 180 is attached to the external side of passageway 240. The framework outlining handle 40 also extends to form compartment 170 where bar 160 is located and permitted to freely rotate without becoming displaced. Rotating bar 160 is positioned relative to rod 150 in a manner that allows the grooves located on both to freely communicate.

Figure 4:
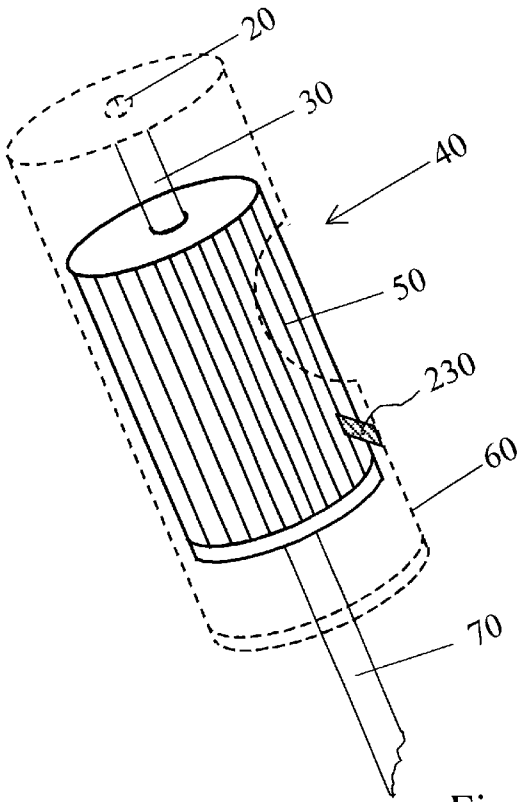
FIG. 4 shows an internal view of an applicator's handle end section. A catch and release pin is located inside which helps to control the brush section's degree of rotation and re-positioning of its internal rod.

FIG. 4 shows an internal view of handle 40 with a catch and release pin 230 located inside. Screw 20 attaches the top end of handle 40 to a first end of stationary bar 30. A second end of stationary bar 30 is connected to one side of disc 50 where disc 50 is rotatably mounted. A second side of disc 50 is fixed to rod 70. The framework outlining handle 40 forms housing 60 and extends to cover a portion of rod 70. On the inside of housing 60, catch and release pin 230 is attached and extends outward in a direction that permits its outer edge to contact the grooves located on disc 50.

Figure 6:
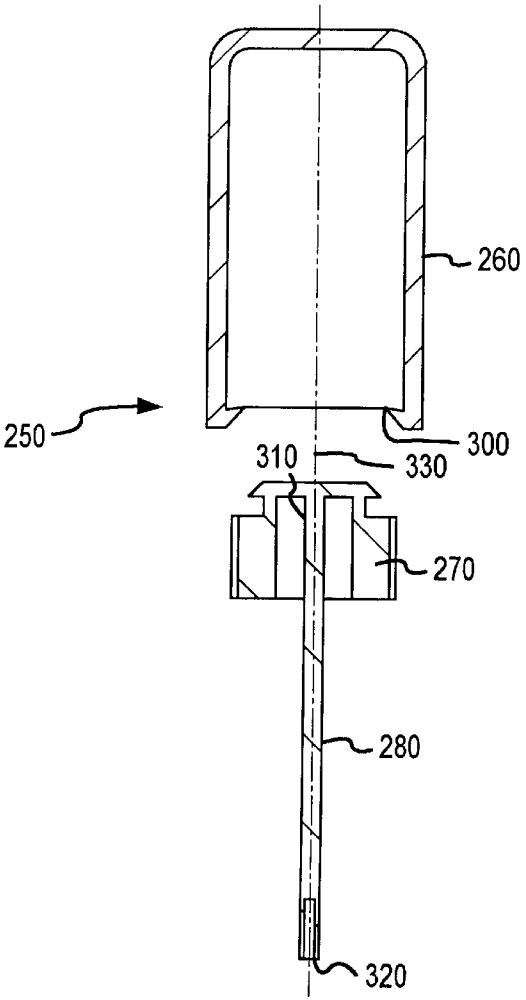
FIG. 6 shows an exploded cross-sectional view of the interactive mascara applicator illustrated in FIG. 5.
Figure 5:
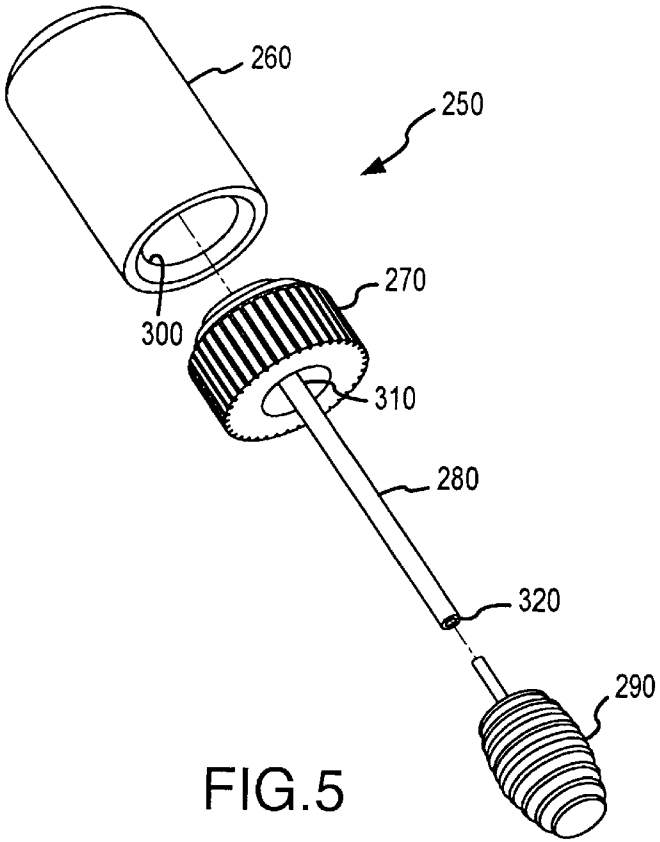
FIG. 5 shows an exploded orthogonal view of an alternative embodiment of the interactive mascara applicator illustrated in FIG. 1.

FIGS. 5 and 6 show an alternative embodiment of the mascara applicator of FIG. 1. Mascara applicator 250 includes handle 260, rotational body 270, rod 280, and bristles 290. An opening 300 is formed in handle 260. Opening 300 is sized to receive and capture rotational body 270. Rotational body 270 is rotatably mounted to handle 260. Rotational body 270 is depicted as a disc, however, rotational body 270 may alternatively be other shapes. For example, rotational body 270 may be a sphere, a bar, a ring, or a dial. Rotational body 270 is affixed to a proximate end 310 of rod 280. Bristles 290 are affixed to a distal end 320 of rod 280.

Operation of the embodiment illustrated in FIGS. 1–6 will now be described.

In FIG. 1, an interactive mascara applicator 10 is shown with a mechanism that allows rod 70 and brush section 80 to freely rotate. Housing 60 forms a window that allows a section of disc 50 to be exposed, such that when disc 50 is turned (using one finger of a single hand), both rod 70 and brush section 80 mimic its movement by also turning. Disc 50 does not get displaced within handle 40 because screw 20 securely fastens one end of stationary bar 30 to the top end of handle 40. A second end of stationary bar 30 rotatably mounts disc 50 where disc 50 freely rotates.

FIG. 1A shows a different interactive approach that allows rod 70 and brush section 80 to freely rotate (brush section 80 is not shown in this figure). External ring 110 is rotatably mounted around handle 40, and located in an area on the surface of housing 60 where one finger of a single hand can turn it. By turning external ring 110, internal ring 100 moves with it in the same direction and at the same speed. Rod 70 is able to mimic the movement of internal ring 100 because its top end is fixed to ring 100 by way of screw 20.

FIG. 1B shows another interactive approach that allows rod 70 and brush section 80 to freely rotate (brush section 80 is not shown in this figure). A section of sphere 90 is exposed through a window formed by housing 60 such that when one finger of a single hand turns it, rod 70 mimics its movement by also turning. Sphere 90 does not get displaced within handle 40 because screw 20 securely fastens one end of stationary bar 30 to the top end of handle 40.

FIG. 1C shows a further interactive approach that allows rod 70 and brush section 80 to freely rotate (brush section 80 is not shown in this figure). A section of external dial 120 is exposed through a window formed by housing 60 such that when one finger of a single hand turns it, rod 70 mimics its movement by also turning. This happens because of the way in which rod 70 is fixed to one side of internal dial 130 and the manner in which the teeth on dial 130 get displaced by the teeth of dial 120. Internal dial 130 remains in place within handle 40 because screw 20 securely fastens one end of stationary bar 30 to the top end of handle 40.

FIG. 2 shows an internal view of an interactive mascara applicator 10 that enables a user to change the alignment of the bristles within brush 190 by turning bar 160.

When bar 160 is turned in a first direction (by using one finger of a single hand), the grooves located on its surface come into contact with the grooves on rod 150. This causes rod 150 to become displaced and to move further inside sleeve 190. Subsequently, sleeve 190 expands and stretches, separating its bristles further apart and changing their alignment. Simultaneously, spring 140 stretches.

The distance that rod 150 moves determines the amount of separation that will occur between the bristles on sleeve 190.

When bar 160 counter-rotates, spring 140 flexes back and helps facilitate the movement of rod 150 out of sleeve 190 so that the bristles can return to their initial alignment. The distance that bar 160 rotates in a first direction represents an array of possible distances or positions that rod 150 can stop at and occupy. Each of these positions represent various spacing changes for the bristles on sleeve 190. Whenever a user desires a particular bristle alignment, bar 160 is rotated and held at that particular point. Pin 180 serves to attach sleeve 190 to housing 60. Screw 20 serves to anchor spring 140 to the internal wall of handle 40. Compartment 170 allows bar 160 to rotate without becoming displaced.

FIG. 2A shows an internal view of an alternate interactive approach that varies the length of rod 150 so that the bristle alignment within its brush section can be modified (brush section is not shown in this figure).

A section of sphere 90 is exposed through a window formed by housing 60 such that when one finger of a single hand turns it, rod 150 moves further inside sphere 90 and thereby decreases the length of rod 150 inside corridor 200. Corridor 200 has internal grooves located inside that serve to stabilize and facilitate rod 150's movement in and out of sphere 90. Sphere 90 does not get displaced within handle 40 because screw 20 securely fastens one end of stationary bar 30 to handle 40's top end.

FIG. 3 shows an internal view of an interactive mascara applicator 10 with mechanisms that enable the shape of its brush section 190 to change.

When bar 160 is rotated in a first direction (by using one finger of a single hand), the grooves located on its surface come into contact with the grooves on rod 150. This causes both rod 150 and piston 210 to become displaced and to move further down inside passageway 240. As this movement occurs, it causes filler material 220 to be pushed further inside sleeve 190 resulting in a change in sleeve 190's curvature. Simultaneously, spring 140 stretches. The distance that bar 160, rod 150 and piston 210 move determines the amount of fill material 220 that will be displaced into sleeve 190 and sleeve 190's derivative curvature shape.

When bar 160 counter-rotates, spring 140 flexes back and helps facilitate the movement of rod 150 and piston 210 out of passageway 240. This causes filler material 220 to return to its initial disbursement pattern. The distance that bar 160 is rotated represent an array of possible distances or positions that rod 150 can stop at and occupy. Each of these positions represent a different curvature for sleeve 190. Whenever a particular curvature shape is desired, bar 160 is rotated and held at that point. Pin 180 serves to attach sleeve 190 to housing 60. Screw 20 serves to anchor spring 140 to the internal wall of handle 40 and compartment 170 allows bar 160 to rotate without becoming displaced.

In FIG. 4, a catch and release pin 230 is shown whose function is to regulate the re-positioning of applicator rod 70. Housing 60 forms a window that allows a section of disc 50 to be exposed, such that when disc 50 is turned (using one finger of a single hand), rod 70 mimics its movement by also turning. Disc 50 does not get displaced within handle 40 because screw 20 securely fastens one end of stationary bar 30 to the top end of handle 40. A second end of stationary bar 30 rotatably mounts disc 50 where disc 50 freely rotates. As disc 50 rotates, its grooves come into contact with the outer edge of catch and release pin 230. Each of the contact points slow the rotation of disc 50 so that one may re-position rod 70 more easily. Catch and release pin 230 also serves to control the degree of rotation that rod 70 will experience.

Mascara applicator 250, illustrated in FIGS. 5 and 6, is operated by rotating rotational body 270. Rotational body 270 is configured relative to handle 260 so that a user of mascara applicator 250 is able to hold handle 260 using one hand and simultaneously rotate rotational body 270 with a finger of the same hand. Rotation of rotational body 270 drives rod 280 to rotate about a longitudinal axis 330 of rod 280. Rotation of rod 280 rotates bristles 290 about longitudinal axis 330.

An interactive approach allows a user to engage in and choose from an array of bristle arrangements and brush shapes all without having to stop in the middle of the application process to perform any adjustments. A rotating disc, ring, sphere, and a set of dials (rotational gear) are generally located about an assembly's handle end section. When one of the rotational gear pieces is engaged (turned), the bristles on the brush interactively and immediately respond. This reaction changes either the bristle alignment, brush section shape, or causes the brush section to freely rotate.

The effect of an "interactive" approach is twofold. First, by giving the bristle's of the brush the capability to be altered in "real time"—during the actual application of the makeup to the lashes, allows changes in combing or stroking patterns to be immediate and direct resulting in no delays during application. This is especially convenient since most mascara formulas today dry quickly once they get exposed to air. Second, the amount or level of "mechanical adjustment" that occurs either among the bristles of the brush, or to the degree that the brush section rotates is directly controlled by the user.

Although the description above contains many specificities, these should not be construed as limiting the scope of the invention but as merely providing illustrations of some of the presently preferred embodiments of this invention.

Thus the scope of the invention should be determined by the appended claims and their legal equivalents, rather than by just the examples given.

What is claimed is:

1. A mascara applicator comprising:

(a) a handle including a housing having an open distal end;

(b) a rotational body rotatably mounted in the open distal end of the housing;

(c) a rod having proximal and distal ends, the rod mounted at its proximal end to the rotational body; and, (d) bristles linked to the distal end of the rod, wherein rotation of the rotational body rotates the rod to move the bristles.

2. A mascara applicator comprising:

(a) a handle having a closed proximal end and a distal end with a window formed in the handle between the proximal and distal ends;

(b) a rod having a longitudinal axis and proximal and distal ends, the proximal end of the rod rotatably mounted within the handle;

(c) bristles linked to the distal end of the rod;

(d) a rotational body engaging the rod and rotatably mounted within the handle, wherein rotation of the rotational body rotates the rod to move the bristles; and, wherein the window exposes at least a portion of the rotational body.

3. The mascara applicator of claim 2 wherein rotation of the rotational body rotates the rod and the bristles about the longitudinal axis of the rod.

4. The mascara applicator of claim 2 further including a movement regulating member positioned within the handle and configured to control the rotation of the rod.

5. The mascara applicator of claim 4 wherein the movement regulating member includes a catch and release pin.

6. The mascara applicator of claim 2 wherein the rotational body includes a disc mounted about the rod and secured to the rod.

7. The mascara applicator of claim 2 wherein the rotational body includes an internal ring mounted about the rod and secured to the rod.

8. The mascara applicator of claim 7 further including an external ring mounted about the handle and affixed to the internal ring, wherein rotation of the external ring rotates the internal ring.

9. The mascara applicator of claim 2 wherein the rotational body includes a sphere mounted about the rod and secured to the rod.

10. The mascara applicator of claim 2 wherein the rotational body includes an internal dial mounted about the rod and secured to the rod.

11. The mascara applicator of claim 10 further including an external dial rotatably mounted to the handle and positioned to engage the internal dial, wherein rotation of the external dial rotates the internal dial.

12. The mascara applicator of claim 2 wherein the rotational body is configured relative to the handle so that a user of the mascara applicator is able to hold the handle using one hand and simultaneously rotate the rotational body with a finger of the same hand.

13. A mascara applicator comprising:

(a) a handle having a closed proximal end and a distal end with a window formed in the handle between the proximal and distal ends;

(b) a rod having a longitudinal axis and proximal and distal ends, the proximal end of the rod moveably mounted within the handle, at least one groove formed in the rod;

(c) bristles linked to the distal end of the rod; and, (d) a rotational body mounted within the handle and positioned to engage the at least one groove in the rod, wherein rotation of the rotational body drives the rod along the longitudinal axis of the rod to move the bristles.

14. The mascara applicator of claim 13 further including a deformable sleeve linked to the rod, wherein the bristles are mounted to the deformable sleeve, and wherein movement of the rod along the longitudinal axis of the rod deforms the deformable sleeve to move the bristles.

15. The mascara applicator of claim 14 further including:

(a) a piston engaging the distal end of the rod;

(b) a filler communicating between the piston and the deformable sleeve; and, wherein movement of the rod along the longitudinal axis of the rod towards the distal end of the rod urges the piston along the longitudinal axis of the rod, forcing filler into the deformable sleeve.

16. The mascara applicator of claim 15 wherein forcing filler into the deformable sleeve elongates the deformable sleeve to separate the bristles.

17. The mascara applicator of claim 15 wherein forcing filler into the deformable sleeve distorts the deformable sleeve to change the shape of the bristles.

18. The mascara applicator of claim 13 wherein the rotational body includes a disc rotatably affixed to the handle, the disc having an opening shaped and positioned to receive the proximal end of the rod and to engage the at least one groove of the rod.

19. The mascara applicator of claim 13 wherein the rotational body includes a sphere rotatably affixed to the handle, the sphere having an opening shaped and positioned to receive the proximal end of the rod and to engage the at least one groove of the rod.

20. The mascara applicator of claim 13 wherein the rotational body includes a bar rotatably affixed to the handle, the bar shaped and positioned to engage the at least one groove of the rod.

21. The mascara applicator of claim 2 wherein the proximal end of the rod is rotatably mounted at the proximal end of the handle.

22. The mascara applicator of claim 2 wherein the proximal end of the rod is rotatably mounted to the rotational body.

23. The mascara applicator of claim 22 further including a stationary bar interlinking the proximal end of the handle and the rotational body.

24. A mascara applicator comprising:

(a) a handle having a window formed therein;

(b) a rotational body mounted within the handle, (c) a rod having a longitudinal axis and proximal and distal ends, the proximal end of the rod rotatably mounted within the handle, the rod engaged by the rotational body;

(d) bristles linked to the distal end of the rod, wherein rotation of the rotational body drives the rod to move the bristles; and, (e) an external actuator rotatably mounted to the handle and linked to the rotational body, wherein rotation of the external actuator induces rotation in the rotational body and wherein the window exposes at least a portion of the external actuator.

25. The mascara applicator of claim 24 wherein:

(a) the rotational body includes an internal ring engaging the rod; and, (b) the external actuator includes an external ring rotatably mounted about the handle and affixed to the internal ring.

26. The mascara applicator of claim 24 wherein:

(a) the rotational body includes an internal dial engaging the rod; and, (b) the external actuator includes an external dial rotatably mounted to the handle and positioned to engage the internal dial.

27. The mascara applicator of claim 24 wherein the proximal end of the rod is rotatably mounted at the proximal end of the handle.

28. The mascara applicator of claim 24 wherein the proximal end of the rod is rotatably mounted to the rotational body.

29. The mascara applicator of claim 28 further including a stationary bar interlinking the proximal end of the handle and the rotational body.

* * * * *